US006877716B2

(12) United States Patent
Noritake

(10) Patent No.: US 6,877,716 B2
(45) Date of Patent: Apr. 12, 2005

(54) MOTOR-OPERATED DAMPER DEVICE

(75) Inventor: Seiichiro Noritake, Nagano (JP)

(73) Assignee: Sankyo Seiki Mfg. Co., Ltd., Nagano (JP)

( * ) Notice: Subject to any disclaimer, the term of this patent is extended or adjusted under 35 U.S.C. 154(b) by 41 days.

(21) Appl. No.: 10/426,901

(22) Filed: Apr. 29, 2003

(65) Prior Publication Data

US 2004/0000655 A1 Jan. 1, 2004

(30) Foreign Application Priority Data

May 1, 2002 (JP) ..... 2002-130009

(51) Int. Cl.[7] ..... F16K 31/02

(52) U.S. Cl. ..... 251/129.12; 251/157; 251/284; 251/298

(58) Field of Search ..... 251/129.112, 157, 251/248, 284, 298

(56) References Cited

U.S. PATENT DOCUMENTS 5,876,014 A * 3/1999 Noritake et al. ..... 251/129.12
5,975,051 A * 11/1999 Yamada et al. ..... 123/396
6,069,466 A * 5/2000 Noritake et al. ..... 318/685

FOREIGN PATENT DOCUMENTS

JP 06-109354 4/1994
JP 09-264652 10/1997

* cited by examiner

*Primary Examiner*—Edward K. Look
*Assistant Examiner*—John K. Fristoe Jr.
(74) *Attorney, Agent, or Firm*—Hogan & Hartson, LLP

(57) ABSTRACT

A motor-operated damper device includes a baffle driving device equipped with a motor, a baffle that is driven by the baffle driving device, a frame defining an opening section that is closed and opened by the baffle, the opening section having a peripheral edge section, and a buffer member that is attached to the baffle and that resiliently deforms and contacts the peripheral edge section of the opening section when the opening section is closed by the baffle. A detent torque of the motor is used to maintain a stopping state in which the buffer member is resiliently deformed to provide a close contact with the peripheral edge section of the opening section. The motor-operated damper device includes a stopper that allows an appropriate amount of elastic deformation of the buffer member and yet prevents the peripheral edge section of the opening section from excessively sinking into the buffer member.

18 Claims, 9 Drawing Sheets

MOTOR-OPERATED DAMPER DEVICE

BACKGROUND OF THE INVENTION

1. Field of the Invention

The present invention relates to a motor-operated damper device in which an opening section is opened and closed by a baffle that is driven by a motor.

2. Related Background Art

A motor-operated damper device 150 that may be used in a refrigerator or other similar devices is shown in FIGS. 10 and 11. The motor-operated damper device 150 includes pivot shafts 151, a baffle 152 that is rotatable about the pivot shafts 151 and a driving mechanism section 153 equipped with a motor for driving the baffle 152. The baffle 152 and the driving mechanism section 153 are disposed on both sides of the pivot shafts 151. While looseness is provided at the baffle 152 and among members within the driving mechanism section 153, a leaf spring (omitted from the drawing) that normally pushes the baffle 152 toward a closing direction is provided at the back of the baffle 152 in order to increase the air-tightness between the baffle 152 and a frame 154. In order to further improve the air-tightness of the baffle 152, a soft tape 155 is attached to a surface of the baffle 152 that abuts against the frame 154 such that, when the baffle 152 is at a closing position, the frame 154 sinks in the soft tape 155.

In the motor-operated damper device 150 shown in FIGS. 10 and 11, the rotational torque of the motor is converted through a cam mechanism into a thrust-direction torque of a spindle, and the baffle 152 is driven by the thrust-direction torque of the spindle to rotate about the rotation pivots 151 as a rotation center. Accordingly, the conventional motor-operated damper device 150 is provided with a structure in which appropriate looseness is given, in consideration of precision of each of components, to the components when the baffle 152 is closed, and the baffle 152 is pressed down by the leaf spring against the frame 154.

Consequently, the conventional motor-operated damper device 150 needs a leaf spring with a substantially large spring force in order to securely provide the air-tightness. As a result, the baffle 152 may be pressed against the soft tape 155 with an excessively strong force such that the frame 154 sinks excessively into the soft tape 155. As opening and closing operations of the baffle 152 are repeated, the soft tape 155 permanently deforms, and looses its softness, such that the baffle 152 can no longer securely provide the required air-tightness.

SUMMARY OF THE INVENTION

The present invention relates to a motor-operated damper device that can prevent looseness without using a leaf spring, and can maintain a high level of air-tightness even when opening and closing operations of a baffle are repeated for a long time.

In accordance with an embodiment of the present invention, a motor-operated damper device includes a baffle driving device equipped with a motor, a baffle that is driven by the baffle driving device, and a frame defining an opening section that is closed and opened by the baffle, wherein one of the baffle and a peripheral edge section of the opening section is provided with a buffer member that resiliently deforms and air-tightly contacts to the other when the opening section is closed by the baffle, and the motor uses its detent torque to maintain a state in which the buffer member is resiliently deformed to provide an air-tight contact with the other. The motor-operated damper device may also include a stopper that allows an appropriate amount of resilient deformation of the buffer member and yet prevents a closing operation of the baffle at a predetermined position to thereby prevent the other from excessively deforming the buffer member.

In one embodiment, the one of the baffle and the peripheral edge section of the opening section is the baffle to which the buffer member is attached, and the other is the peripheral edge section of the opening section.

In the motor-operated damper device in accordance with the present embodiment, the rotational force of the motor is transmitted to the baffle, and the baffle opens and closes the opening section in the frame. When the baffle closes the opening section, a force is applied by the detent torque of the motor to the baffle in a closing direction in which the baffle is closed. As a result, the opening section is securely closed by the baffle, and therefore a leaf spring or other spring devices are not required to push the baffle. Also, the buffer member is provided on the baffle such that the peripheral edge section of the opening section resiliently deforms (e.g., sinks into) the buffer member when the baffle closes the opening section; this makes the baffle to securely close the opening section. Further, since the stopper prevents the peripheral edge section of the opening section from excessively sinking into the buffer member, the buffer member does not excessively deform. Accordingly, each time the buffer member is deformed, the buffer member recovers its original shape, and even when opening and closing operations of the baffle are repeated, the buffer member maintains its original shape, and a gap may not be generated between the opening section and the baffle even after the device is used for a long time.

In accordance with an embodiment of the present invention, the motor may preferably have a torque that allows the other to sink into the buffer member against the resilience of the buffer member to a position where the closing operation of the baffle is prevented by the stopper. With this structure, while an excessive deformation of the buffer member is prevented, opening and closing operations of the baffle can be performed without a problem even when a motor with a large torque is used to prevent troubles of freezing of the baffle, and even when a freezing takes place.

In accordance with an embodiment of the present invention, the motor may preferably be driven until the baffle reaches a position where the closing operation of the baffle is prevented by the stopper, and may preferably maintain at the position a state in which the baffle is kept in close contact with the buffer member by the detent torque. In this manner, by having the motor always drive the baffle up to the position where the closing operation of the baffle is prevented by the stopper, the stop position of the baffle can be maintained at constant, and the sinking (deformation) of the buffer member can be maintained at an appropriate level. As a result, the state in which the baffle is kept in close contact with the buffer member by the detent torque of the motor can be set at an appropriate position in view of deformation of the buffer member and air-tightness of the buffer member.

Also, in the present embodiment, when the driving of the motor is stopped at the position where the closing operation is prevented by the stopper, the baffle may preferably be kept in close contact with the buffer member at a position where the resilient returning force of the buffer member balances with the detent torque of the motor. In other words, when the driving of the motor is stopped at the position where the closing operation of the baffle is prevented by the stopper, the baffle may be in a stopping state in which the baffle is slightly pushed back by a repelling force caused by the sinking (deformation) of the buffer member to balance with the detent torque of the motor and stop in this stopping state. There would be no problem if the stopping state provides a predetermined level of air-tightness.

In the present embodiment, the baffle driving device may include a case that contains the motor and a reduction gear train that transmits an output of the motor to the baffle, and the stopper may preferably be provided within the case.

The reduction gear train is composed of a plurality of gears, and the stopper may preferably be structured such that the stopper interferes with one of the plurality of gears that rotates less than one full turn while the baffle moves from a complete open state of the opening section to a complete close state of the opening section to thereby stop the baffle and prevent the circumferential edge section of the opening section from excessively sinking into the buffer member.

In one embodiment, the stopper may be provided at a position that is further shifted in a closing direction from a designed stopping position where the baffle places the opening section in the complete close state to stop the baffle. With this structure, the stopper merely functions as a safeguard, and does not function under normal operational conditions.

Other features and advantages of the invention will be apparent from the following detailed description, taken in conjunction with the accompanying drawings that illustrate, by way of example, various features of embodiments of the invention.

BRIEF DESCRIPTION OF DRAWINGS

FIG. 1(*b*) shows a state in which a circumferential edge section of an opening section in the motor-operated damper device in FIG. 1(*b*) excessively sinks in a soft tape attached on a baffle.

PREFERRED EMBODIMENTS OF THE PRESENT INVENTION

Embodiments of the present invention will be described with reference to the accompanying drawings.

[Embodiment 1]

(Structure of Opening Section and Baffle)

Figure 1:
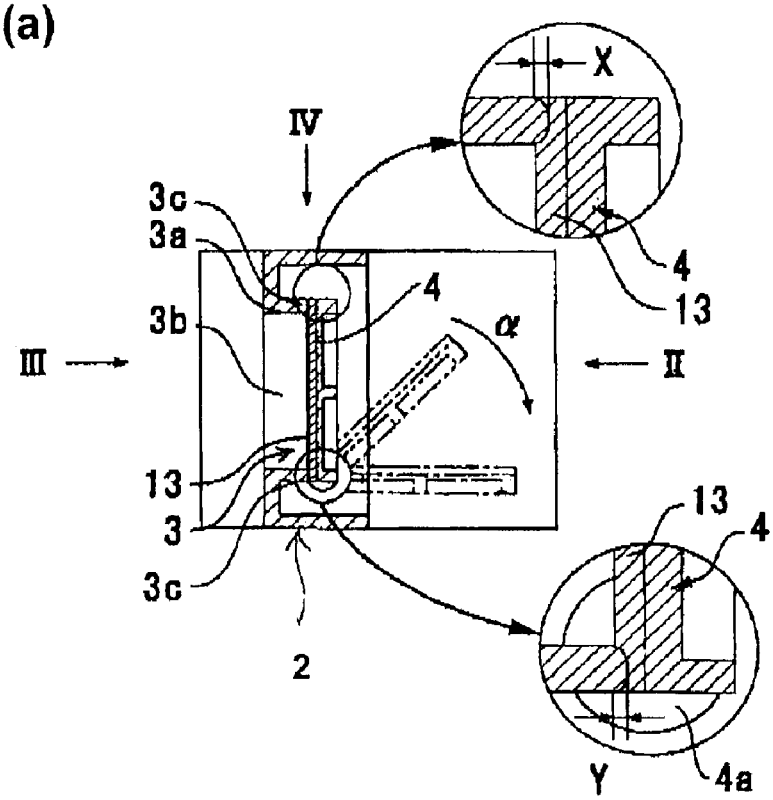
FIG. 1(*a*) is a cross-sectional view of a motor-operated damper device in accordance with a first embodiment of the present invention.
Figure 1:
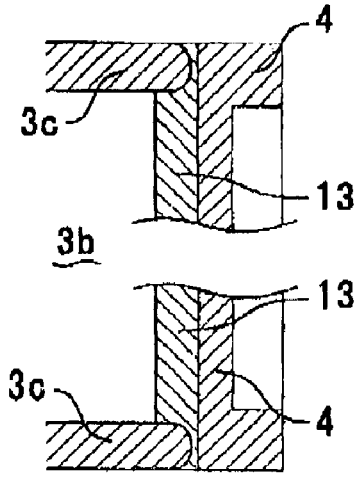
Figure 2:
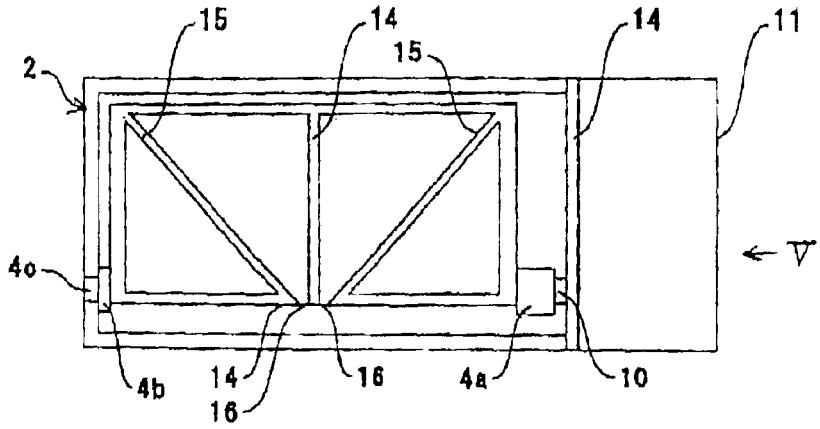
FIG. 2 is a rear view of the motor-operated damper device in FIG. 1(*a*) as viewed in a direction indicated by an arrow II in FIG. 1(*a*).
Figure 3:
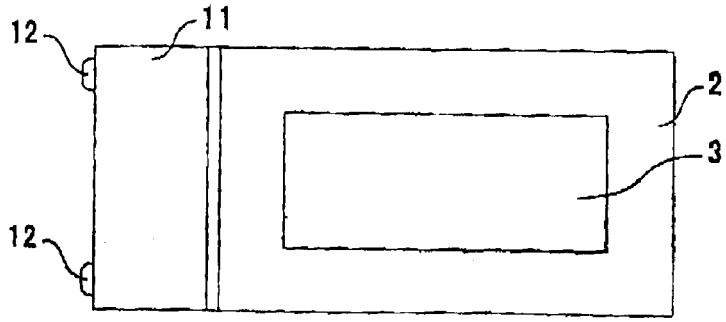
FIG. 3 is a front view of the motor-operated damper device in FIG. 1(*a*) as viewed in a direction indicated by an arrow III in FIG. 1(*a*).
Figure 4:
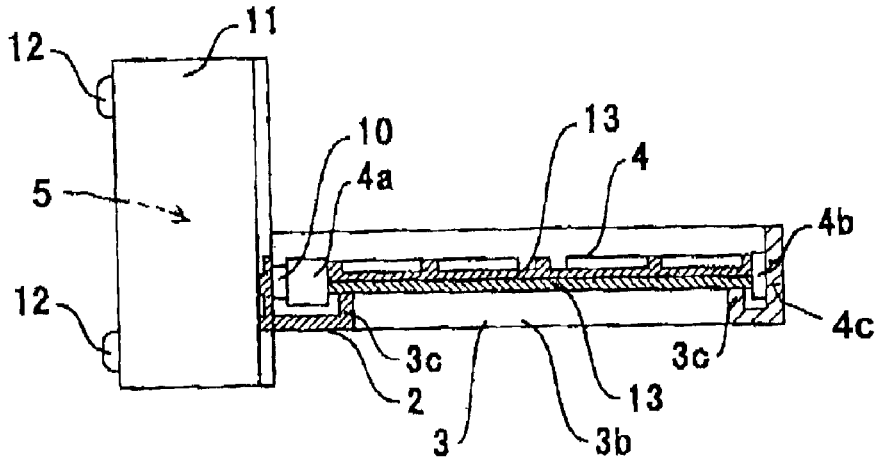
FIG. 4 is a partially cross-sectional plan view of the motor-operated damper device in FIG. 1(*a*) as viewed in a direction indicated by an arrow IV in FIG. 1(*a*).

FIG. 1(*a*) is a cross-sectional view of a motor-operated damper device in accordance with a first embodiment of the present invention, and FIG. 1(*b*) shows a state in which a circumferential edge section of an opening section in the motor-operated damper device in FIG. 1(*b*) excessively sinks in a soft tape attached to a baffle. FIGS. 2, 3 and 4 are a rear view, a front view and a partially cross-sectional plan view of the motor-operated damper device shown in FIG. 1(*a*) as viewed in a direction indicated by an arrow II, in a direction indicated by an arrow III, and in a direction indicated by an arrow IV in FIG. 1 (a), respectively.

The motor-operated damper device in accordance with the first embodiment may be used in a refrigerator or a similar device, and mainly composed of, as shown in FIG. 1(*a*), a baffle driving mechanism to be described in greater detail below, a frame 2 that may be in a cylindrical shape having open ends, an opening section 3 that is formed in the frame 2, and a baffle 4 that is opened and closed with respect to the opening section 3.

The frame 2 may be formed from an ABS resin formed member that may be in a square pole shape, and a resin cover 11 is mounted on the frame 2 by screws 12 or the like, as indicated in FIGS. 2–4. A baffle driving mechanism 5 to be described below in greater detail is provided within a case that is composed of the cover 11 and the frame 2.

The opening section 3 includes an opening forming section 3*a* that protrudes from the frame 2 and an opening 3*b* that is surrounded by the opening forming section 3*a*. The opening forming section 3*a* has at its tip section a protruded section 3*c* that can abuts against the baffle 4, thereby forming an abutting surface that abuts against the baffle 4. In the illustrated embodiment, the opening section 3 is formed with the frame in one piece. However, the opening section 3 may be formed as an independent member.

The baffle 4 may be formed from polycarbonate. A soft tape 13, which serves as a buffer member, is affixed to a surface of the baffle 4 on the side of the opening section 3, thereby composing a part of the baffle 4. The soft tape 13 may be composed of foamed polyurethane to provide a relatively large sinking or deformation when the soft tape 13 abuts against the protruded section 3*c*. Any one of other elastic material members, such as, for example, foamed polyethylene member and rubber member may be used as the soft tape 13.

The rear side of the baffle 4 may be provided with ribs 14 that may be square or in any one of appropriate shapes as shown in FIG. 2 to reinforce the strength of the baffle 4. Water drain sections 16 may be provided in the rear of the baffle 4 by cutting portions of diagonal rib sections 15 and the ribs 14 to prevent frost and water from adhering to the baffle 4 and becoming ice.

The baffle 4 is equipped with shaft sections 4*a* and 4*b* on both sides thereof. A protruded shaft 4*c* is formed on the shaft section 4*b*, and the protruded shaft section 4*c* is rotatably supported by an engaging hole provided in the frame 2. The shaft section 4*a* engages a rotation center shaft 10 extending from the motor side, and rotational supports the baffle 4. The baffle 4 can move between a closed position indicated by a dot-and-dash line and a opened position indicated by a solid lien in FIG. 1(*a*).

(Structure of Baffle Driving Mechanism)

Figure 5:
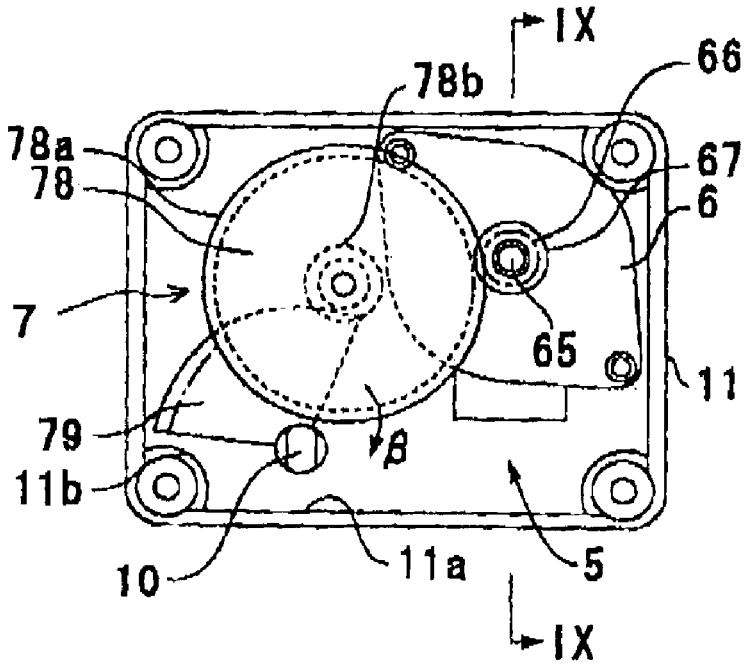
FIG. 5 is a side view of a baffle driving mechanism used in the motor-operated damper device in accordance with the first embodiment with its cover being removed and as viewed in a direction indicated by an arrow V in FIG. 2.
Figure 6:
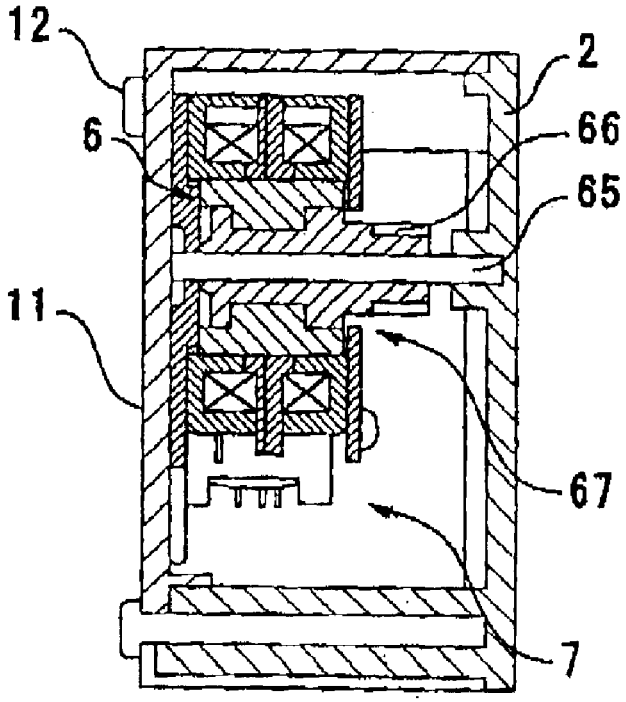
FIG. 6 is a cross-sectional view of the motor-operated damper device in accordance with the first embodiment taken along lines IX—IX in FIG. 5.

FIG. 5 is a side view of a baffle driving mechanism used in the motor-operated damper device in accordance with the first embodiment with its cover 11 being removed, as viewed in a direction indicated by an arrow V in FIG. 2. FIG. 6 is a cross-sectional view of the motor-operated damper device taken along lines IX—IX in FIG. 5.

As indicated in FIGS. 5 and 6, the baffle driving mechanism 5 is mainly composed of a stepping motor 6, and a reduction gear train 7 that reduces the speed of an output of the stepping motor 6 and transmits the output. In the present embodiment, the reduction gear train 7 is composed of a pinion 66, a gear 78 and a fan-shaped gear 79, as described in greater detail below.

The stepping motor 6 has a fixed shaft 65, and a rotor 67 having the pinion 66 is rotatably mounted on the fixed shaft 65. The pinion 66 engages a gear teeth section 78*a* of the gear 78, and a pinion section 78*b* of the gear 78 engages the fan-shaped gear 79. The rotation center shaft 10, which is a center shaft of the fan-shaped gear 79, engages the shaft section 4*a* of the baffle 4 to transfer rotations of the fan-shaped gear 79 to the shaft section 4*a* of the baffle 4. Accordingly, the reduction gear train 7 reduces the rotation speed of the stepping motor 6 and transmits the rotation to the fan-shaped gear 79, thereby rotating the baffle 4.

The fan-shaped gear 79 rotates less than one full-turn while the baffle 4 changes the opening 3*b* from its complete open state to its complete closed state. In the present embodiment example, an opening angle of the fan-shaped gear 79 is about 110 degree, and its rotation operational range β about the rotation center shaft 10 is about 90 degree.

A side surface section 11*a* of the cover 11 is located at a position further away from an expected stop position in an opening direction of the fan-shaped gear 79. The side surface section 11*a* prevents the fan-shaped gear 79 from further rotating in the opening direction to exceed over the expected stop position.

On the other hand, a screw seat section 11*b* of the cover 11 is located at a position further away from an expected stop position in a closing direction of the fan-shaped gear 79. The screw seat section 11*b* of the cover 11 functions as a stopper that prevents the fan-shaped gear 79 from further rotating in the closing direction to exceed over the expected stop position.

The circuit structure of the stepping motor 6 is known and therefore its description omitted. In one example, the stepping motor 6 may be composed to be driven with bi-poles, whose torque during rotation is about 40 g·cm, and detent torque is about 10 g·cm. An output of the stepping motor 6 is reduced by the reduction gear train 7, such that its output torque is set to be about 1,000 g·cm, and its static torque, in other words, a torque at which a rotational position is retained by a detent torque of the stepping motor 6, is set to be about 250 g·cm.

Accordingly, the stepping motor 6 has a torque that can make the protruded section 3*c* to sink in the soft tape 13 against the resilient force of the soft tape 13 up to a position where the closing operation of the baffle 4 is prevented. In other words, the stepping motor 6 has a sufficiently large torque that can achieve open and close operations of the baffle 13 without a problem even when a freezing occurs.

The motor-operated damper device in accordance with the present embodiment may be assembled into a refrigerator. The refrigerator may include, for example, a duct for conducting cooled air from a cooler to a refrigerating chamber. The motor-operated damper device in accordance with the present embodiment may be inserted in a section of the duct that leads to the refrigerating chamber. The motor-operated damper device may be installed such that the frame 2 of the motor-operated damper device forms a part of the duct, and the motor-operated damper device itself also serves as a part of the duct.

(Operations of Motor-Operated Damper Device)

In the present embodiment, the refrigerator is equipped with a CPU that controls temperatures inside the refrigerator. As the CPU instructs the motor-operated damper device to introduce cooled air, the stepping motor 6 is driven in an opening drive direction, in which the rotation of the stepping motor 6 is transmitted through the pinion 66, the gear 78, the fan-shaped gear 79, the rotation center shaft 10, and the shaft sections 4*a* and 4*b* to the baffle 4, and then the baffle 4 moves away from the opening section 3, and moves to an open position (indicated by a dot-and-dash line in FIG. 1(*b*)) that is in parallel with the frame 2.

When the baffle 4 assumes the open position, the stepping motor 6 stops driving. In this instance, even when an error in detecting the number of steps of the stepping motor 6 occurs, and the stepping motor 6 does not stop, the fan-shaped gear 79 abuts against the side surface section 11*a* of the cover 11 and further rotations of the stepping motor 6 are prevented. Then the state in which the baffle 4 is in the open position (which may be referred to below as an "open position state") is maintained by an energization retaining force or a detent torque of the stepping motor 6.

The open position state may be maintained until a target chamber to which cooled air is sent, for example, a refrigerating chamber is cooled and reaches a specified temperature, a signal indicating to close the baffle 4 may be generated. Then, the stepping motor 6 is rotated in an opposite direction (i.e., a closing drive direction) to the opening drive direction, and the baffle 4 is driven in a direction in which the baffle 4 is closed. Moving positions are detected by counting the number of pulses of the stepping motor 6; when the counted number reaches a specified number of pulses, a determination is made that the baffle 4 has reached a closed position, and the driving of the stepping motor 6 is stopped.

The stepping motor 6 may stop its driving after it further rotates in several steps after the soft tape 13 affixed to the baffle 4 comes in contact with the protruded section 3*c* of the opening section 3. In other words, the stepping motor 6 is driven for a little while even after the baffle 4 has come in contact with the protrudes section 3*c*. The number of additional steps can be determined in view of the target amount of deformation (sinking) of the soft tape 13.

In this manner, in the motor-operated damper device in accordance with the present embodiment, since the stepping motor 6 is driven even after the baffle 4 has come in contact with the protruded section 3*c*, the torque of the stepping motor 6 is applied to the baffle 4, the soft tape 13 that has a resilience is pressed by the protruded section 3*c*, and the protruded section 3*c* sinks into the soft tape 13 such that the protruded section 3*c* is brought into tight contact with the soft tape 13 without a gap.

At this moment, if there are variations in the amount of protrusion of the protruded section 3*c* of the opening section 3 or in the shape of the baffle 4, or backlash in the gears such as the gear 78, there is a possibility that the contact between the protruded section 3*c* and the soft tape 13 may not be completely accomplished. However, in the motor-operated damper device in accordance with the present embodiment, the stepping motor 6 is driven for a while after the soft tape 13 has come in contact with the protruded section 3*c* to sink the protruded section 13*c* into the soft tape 13. Accordingly, even if there are such variations as described above, the opening 3*b* can be securely closed by the baffle 4.

When the power supply to the stepping motor 6 is stopped, the resilient repelling force of the soft tape 13 is transmitted through the rotation center shaft 10 to the gear sections such as the fan-shaped gear 79 and the gear 78 and the rotor 67. However, as described above, the stepping motor 6 has a detent torque, and therefore the rotor 7 does not rotate. For this reason, no backlash occurs in the gears 78 and 79, such that no looseness occurs in the transmission mechanism from the rotor 67 of the stepping motor 6 to the baffle 4.

Moreover, since the detent torque of the stepping motor 6 is substantially large, which is about 250 g·cm, at the rotation center shaft 10 in the present embodiment, the baffle 4 is firmly retained at its closed position.

When the closing operation takes place, even if the stepping motor 6 does not stop at the specified position due to, for example, a detection error in counting the number of steps, the fan-shaped gear 79 shown in FIG. 5 abuts against the screw seat section 11*b* (stopper), such that further rotations of the rotation center shaft 10 and the baffle 4 are prevented. Accordingly, as shown in FIG. 1(*a*), after the baffle 4 sinks in the soft tape 13 by an appropriate amount X to thereby close the opening 3*b*, a state in which the baffle 4 excessively sinks in the soft tape 13 (see FIG. 1(*b*)) can be avoided.

Accordingly, even when the structure described above, in which the protruded section 3*c* sinks into the soft tape 13 affixed to the baffle 4 to close the opening 3*b*, is adopted, the stopper described above can be set at a position before the position at which the soft tape 13 has a deformation that cannot return to its original shape, in other words, before the position indicated in FIG. 1(*b*), to thereby avoid an incident in which the soft tape 13 is excessively deformed, or depressed by an abutting member, which is the protruded section 3*c* in the present embodiment. For this reason, even when closing and opening operations of the baffle 4 are repeated, the soft tape 13 can resume its original shape each time the closing and opening operations take place, and no gap is generated between the protruded section 3*c* and the baffle 4 even after it is used for a long time.

In the embodiment described above, the screw seat section 10*b*, which serves as a stopper, is located to stop the baffle 4 at a position further shifted in the closing direction from the expected stop position where the baffle 4 places the opening 3*b* in the fully closed state. For this reason, the stopper mechanism that uses the screw seat section 11*b* functions as a safeguard, and does not function during normal operational conditions.

In the embodiment described above, when the baffle 4 is driven in the closing direction, shift positions of the baffle 4 are detected based on the number of pulses. When the number of pulses reaches a predetermined number, a determination is made that the baffle 4 is at the closed position, and the driving of the stepping motor 6 is stopped. However, in another embodiment, the stepping motor may be driven until the fan-shaped gear 79 abuts against the screw seat section 11*b* (stopper) of the cover 11, and stopped when the fan-shaped gear 79 abuts against the screw seat section 11*b* of the cover 11. In this case, the stopper may be located at the same position as the expected stop position of the stepping motor 6 that is determined by the pulse number, or at a position where a slight deformation occurs in the soft tape. In another embodiment, the shift position of the baffle 4 may not be detected based on the pulse number, but may be determined by the position of the stopper itself.

With the structure described above, the baffle 4 is not always driven further in the closing direction than generally the expected stop position, and an incident in which the soft tape 13 is excessively deformed can be prevented from occurring. Also, even when the rotation torque of the motor is large, the soft tape 13 is not excessively deformed (i.e., the protruded section 3*c* does not excessively sink in the soft tape 13), no gap is generated between the protruded section 3*c* and the baffle 4 even after a long time of use. On the other hand, a motor that has a large rotation torque can be used in the present embodiment, the opening state can be securely achieved even when a freezing occurs in the closing state.

When the baffle 4 needs to be stopped not at the fully opened position but at an intermediate position between the fully opened position and the fully closed position (as indicated by a two-dot-and-dash line in FIG. 1(*a*)), the baffle 4 may be moved to the closed position first to return the baffle 4 to an original position, and then the stepping motor 1 is stopped at a stage where the number of pulses is less than the number of pulses that defines the fully opened position. It is noted that, in the present embodiment, a shift angle $\alpha$ of the baffle 4 from the opened position (indicated by a dot-and-dash line in FIG. 1(*a*)) to the closed position (indicated by a solid line in FIG. 1(*a*)) is 90 degree. However, the shift angle $\alpha$ can be any appropriate angle other than 90 degree.

In the embodiment described above, since the stepping motor 6 is used as a motor, normal and reverse rotations of the motor are possible, and the baffle 4 can be directly opened and closed without the intervention of the cam and spindle.

Also, when the protruded section 3*c* sinks into the soft tape 13, the amount (Y) of deformation (sinking) of the soft tape 13 on a side that is close to the rotation center shaft 10 may become smaller, and the amount (X) of deformation (sinking) of the soft tape 13 on a side that is far from the rotation center shaft 10 may become greater. In this case, there is a possibility that the contact condition on the side close to the rotation center shaft 10 may become deteriorated. Accordingly, the position of the rotation center shaft 10 to be located may preferably be appropriately adjusted such that deformation amounts of the soft tape 13 caused by the protruded section 3*c* at the sides close to and far from the rotation center shaft 10 become equal to each other as mush as possible.

Also, in addition to the stepping motor 6 as the motor, a CD motor, an AC synchronous motor or the like can be used. However, when a DC motor is used as the motor, a position detection device for detecting the position of the baffle 4 may need to be provided. For example, a magnet may be affixed to the fan-shaped gear 79, and a detection device such as a Hall element for detecting the position of the magnet may be used, or the operation time for operating the motor may need to be controlled.

Furthermore, in the embodiment described above, the reduction gear train is used. However, such a reduction gear train may not be necessary. Also, the stepping motor 6 may be driven by the bipolar driving method However, any one of driving methods other than the bi-pole driving method, such as, for example, a unipolar driving method can be used depending on the requirements, and a variety of specifications such as the step angle, torque and the like can be adjusted to values that are most suitable for each of particular modes of use.

Figure 10:
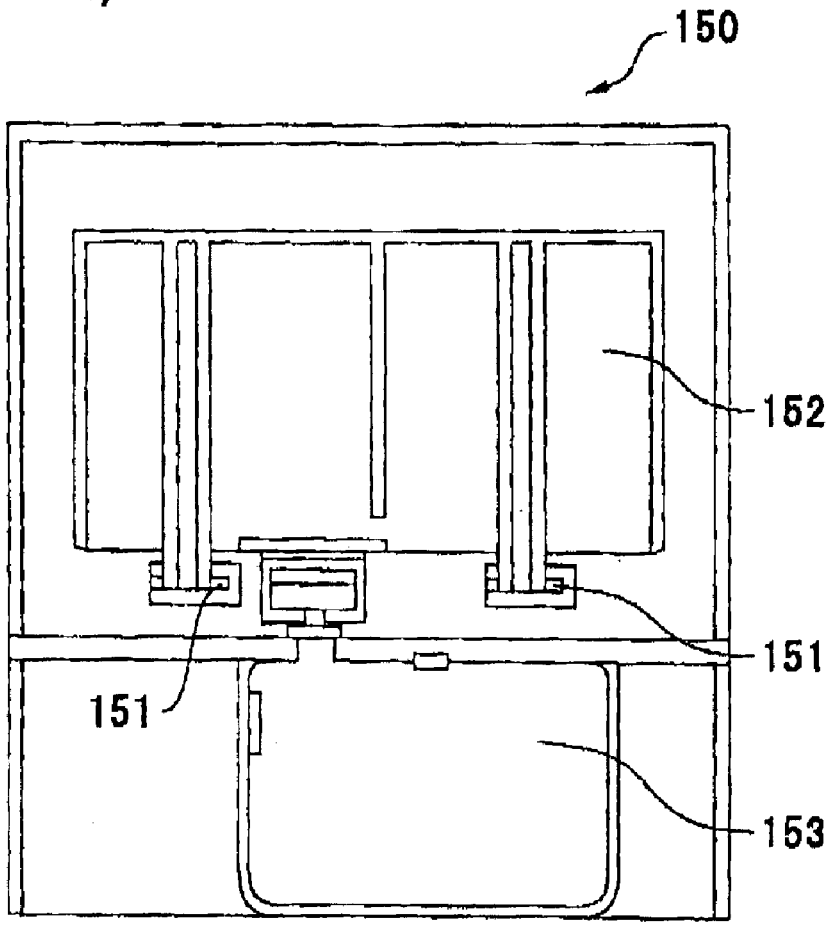
Fig. 10 (Prior Art)
FIG. 10 is a rear view of a conventional motor-operated damper device.
Figure 11:
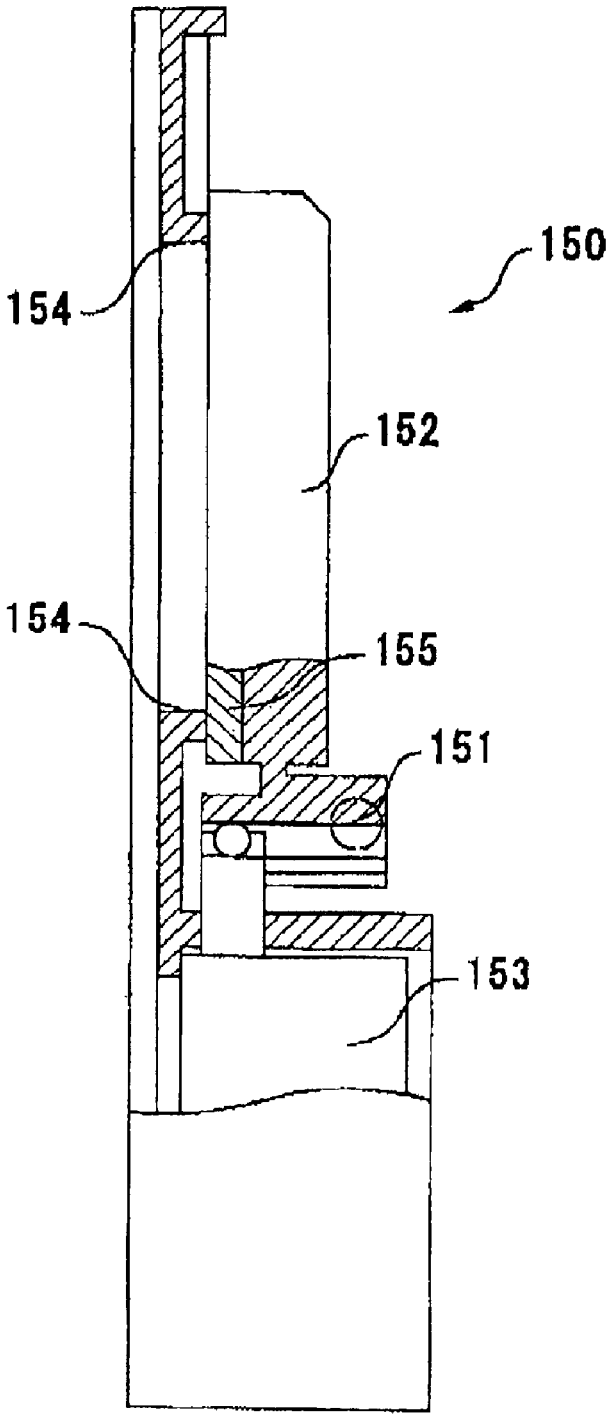
Fig. 11 (Prior Art)
FIG. 11 is a partially cross-sectional side view of a conventional motor-operated damper device.

Also, in the embodiment described above, the damper device has the frame 2 in a duct form. However, the present invention is also applicable to a damper device that is similar to the conventional damper device shown in FIG. 10. Also, the present invention is applicable not only to a refrigerator but also to a variety of damper devices that control fluids, such as, for example, ducts for ventilation. Moreover, the frame 2 may be structured with a frame on the side on which the damper device is mounted, for example, with a duct for ventilating cooled air of the refrigerator.

[Embodiment 2]

Figure 7:
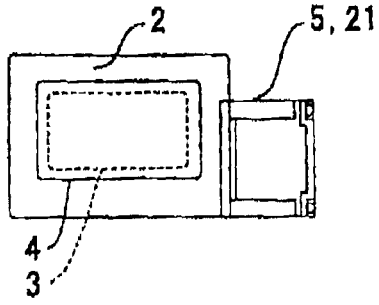
FIGS. 7(*a*), 7(*b*) and 7(*c*) are a front view, a partially cross-sectional right side view and a partially cross-sectional bottom view of a motor-operated damper device in accordance with a second embodiment of the present invention, respectively.
Figure 7:
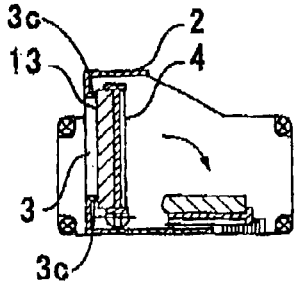
Figure 7:
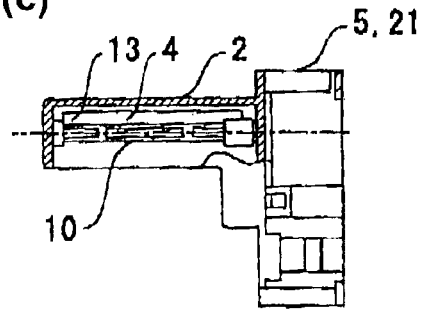
Figure 8:
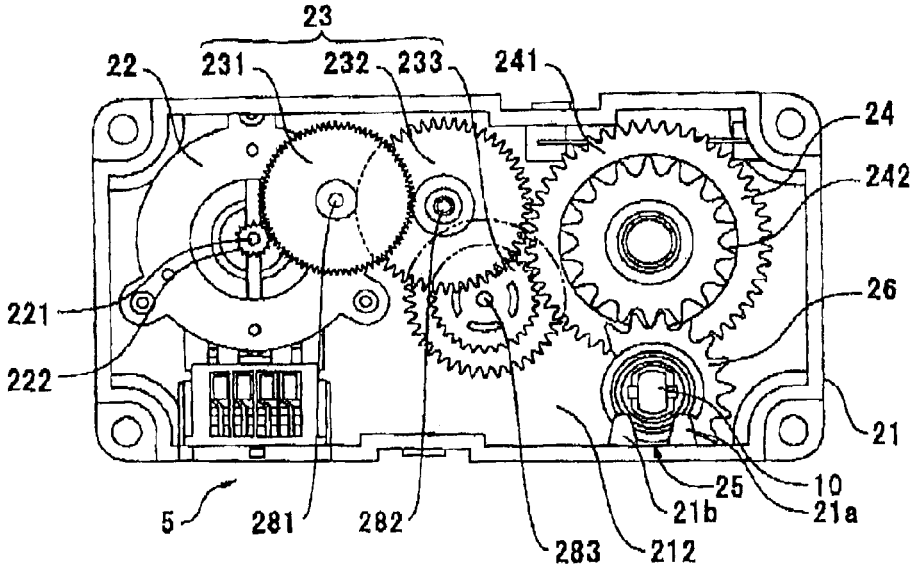
FIG. 8 is a plan view of an internal structure of a baffle driving mechanism of the motor-operated damper device shown in FIGS. 7(*a*), 7(*b*) and 7(*c*).
Figure 9:
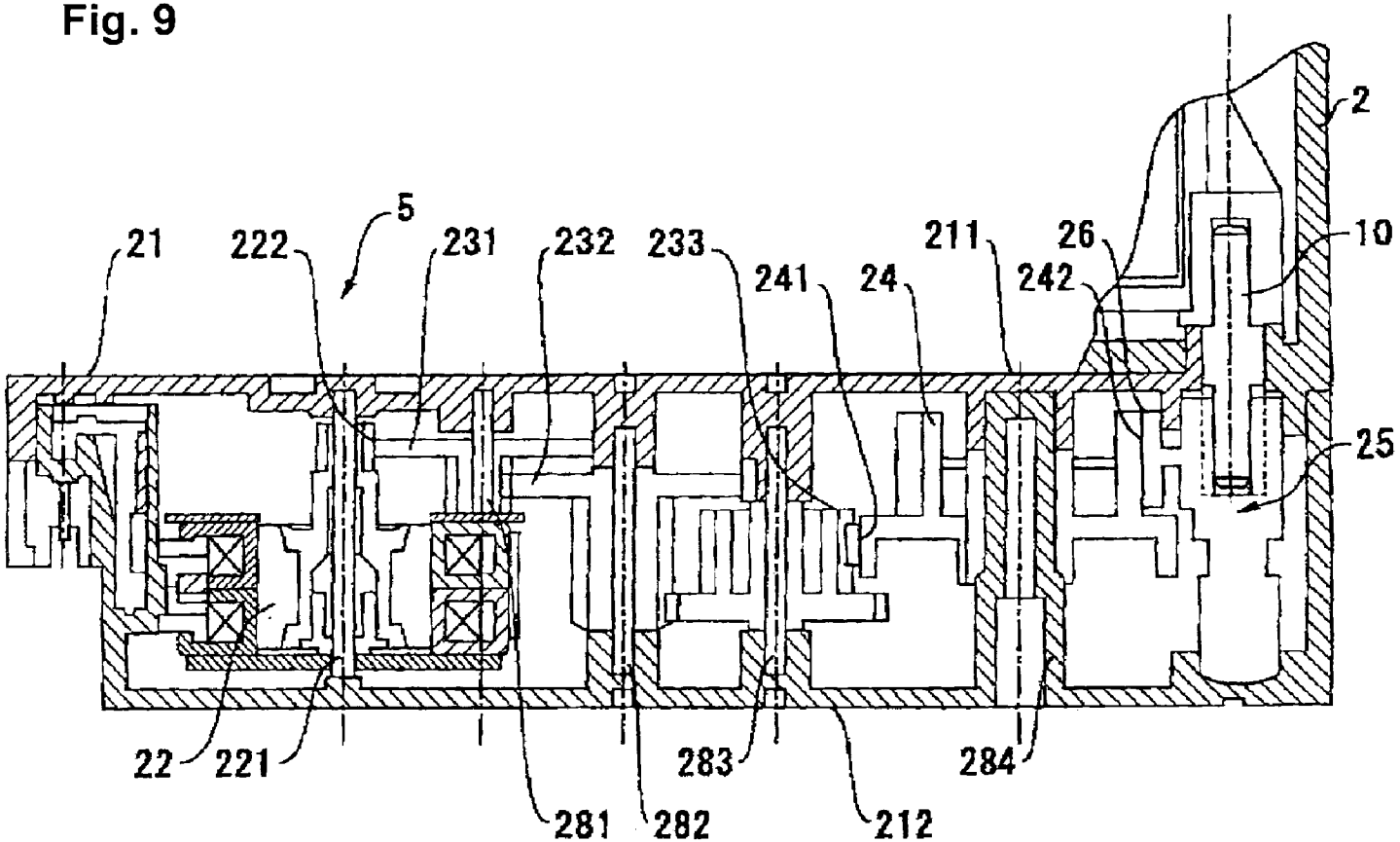
FIG. 9 is a developed longitudinal cross-sectional view of the baffle driving mechanism shown in FIG. 8.

FIGS. 7(*a*), 7(*b*) and 7(*c*) are a front view, a partially cross-sectional right side view and a partially cross-sectional bottom view of a motor-operated damper device in accordance with a second embodiment of the present invention, respectively. FIG. 8 is a plan view of an internal structure of a baffle driving mechanism of the motor-operated damper device shown in FIGS. 7(*a*), 7 (b) and 7(*c*). FIG. 9 is a developed longitudinal cross-sectional view of the baffle driving mechanism shown in FIG. 8.

Referring to FIGS. 7(*a*), 7(*b*) and 7(*c*), the motor-operated damper device in accordance with the second embodiment includes a baffle driving mechanism 5, a resin frame 2 that is disposed at a side of the baffle driving mechanism 5, an opening section 3 that is formed in the frame 2, and a baffle 4 that may be made of resin for opening and closing the opening section 3. A rotation center shaft 10 for the baffle 4 has one end coupled to the frame and another end that is inserted in the baffle driving mechanism 5.

A soft tape 13, which may be made of foamed polyurethane, is attached as a buffer member to a surface of the baffle 4 on the side of the opening section 3. Accordingly, when the baffle 4 closes the opening section 3, a protruded section 3*c* that is formed along a circumferential section of the opening section 3 tightly contacts to and sinks in the soft tape 1.

Referring to FIGS. 8 and 9, the baffle driving mechanism 5 is formed within a resin case 21, and includes within the case 21 a stepping motor 22 and a reduction gear train 23 that reduces the rotation speed of the stepping motor 22 and transmits the rotation of the stepping motor 22 to the baffle 4.

The case 21 may be in a rectangular parallelepiped shape having side surfaces 211 and 212. A rotation center shaft 221 of the stepping motor 22 and a plurality of fixed shafts 281, 282, 283 and 284 are disposed extending between the side surfaces 211 and 212.

A first reduction gear 231, a second reduction gear 232 and a third reduction gear 233 of the reduction gear train 23 are rotatably supported on the fixed shafts 281, 282 and 283, respectively. A driving gear 24 is rotatably supported on the fixed shaft 284.

The stepping motor 22 is a common driving source that is capable of rotating in two opposite directions to drive the baffle 4 in an opening direction and a closing direction. The stepping motor 22 has a rotation center shaft 221, and a pinion 222 is mounted on the rotation center shaft 221. Rotations of the pinion 222 are transmitted to the driving gear 24.

The driving gear 24 has a receiving teeth section 241 having gear teeth formed along its entire outer circumference to transmit rotations of the third reduction gear 233, and is equipped with feeding gear teeth 242 provided above the receiving teeth section 241 in the axial direction to feed a follower gear 25.

The follower gear 25 is formed with a fan-shaped gear 26 in one piece, and the fan-shaped gear 26 engages the feeding gear teeth 242 of the driving gear 25. Also, the follower gear 25 is linked to the rotation center shaft 10 of the baffle 4 such that the baffle 4 is opened and closed as the follower gear 25 rotates.

A protrusion 21*a* protrudes from the case 21 at a position further away from an expected stop position of the baffle 4 in an opening direction in which the follower gear 25 is rotated. The protrusion 21*a* prevents the fan-shaped gear 26 from further rotating in the opening direction to exceed over the expected stop position.

Also, a protrusion 21*b* protrudes from the case 21 at a position further away from an expected stop position of the baffle 4 in a closing direction of the follower gear 25. The protrusion 21*b* functions as a stopper that prevents the fan-shaped gear 26 from further rotating in the closing direction to exceed over the expected stop position. The actions of these stoppers are the same as those of the aforementioned embodiment.

In other words, the protrusion 21*b*, which functions as a stopper, can be provided such that the baffle 4 is stopped at a position further shifted in the closing direction from the expected stop position at which the baffle 4 places the opening 3 in a fully closed position. In this instance, the stopper mechanism that uses the protrusion 21*b* merely functions as a safeguard, and does not operate in normal operational conditions.

Also, in the second embodiment, the stepping motor may be driven until the fan-shaped gear 26 abuts against the protrusion 21*b* (stopper), and stopped when the fan-shaped gear 26 abuts against the protrusion 21*b*. In this case, the stopper may be located at the same position as the expected stop position of the stepping motor 6 that is determined by the pulse number, or at a position where a slight deformation occurs in the soft tape, like the first embodiment.

In the motor-operated damper device thus structured, when the stepping motor 22 is driven, its rotation is transmitted through the reducing gear train 23 to the follower gear 25, and the baffle 4 is operated in a similar manner as the aforementioned embodiment.

In the present embodiment also, when the baffle 4 is rotated in the closing direction, the protruded section 3*c* (at a circumferential edge section) of the opening section 3 contacts the soft tape 13 that is affixed to the baffle 4, and then after a while the stepping motor 22 is stopped. As a result, the torque of the stepping motor 22 is applied to the baffle 4, the soft tape 13 having a resilience is pressed by the protruded section 3*c*, and the protruded section 3*c* of the opening section 3 sinks in the soft tape 13 such that the protruded section 3*c* abuts against the soft tape 13 without a gap.

Also, when the power supply to the stepping motor 22 is stopped in the closed state of the baffle 4, the resilient repelling force of the soft tape 13 is transmitted through the rotation center shaft 10 to the gears and the rotor. Accordingly, even if the baffle 4 is pushed back in the opposite direction by the resilient repelling force of the soft tape 13, the rotor does not rotate because the stepping motor 22 has a detent torque, and the resilient repelling force of the soft tape 13 to push back the baffle 4 balances with the detent torque of the stepping motor 22. For this reason, no backlash occurs in the gears, and no looseness occurs in the transmission mechanism from the rotor or the stepping motor 22 to the baffle 4. Moreover, since the detent torque of the stepping motor 22 is substantially large at the rotation center shaft 10 in the present embodiment, the baffle 4 is firmly retained at its closed position.

Accordingly, the baffle 4 can be maintained in a state in which it sinks in the soft tape 13 by an appropriate amount to thereby close the opening, and a situation in which the baffle 4 excessively sinks in the soft tape 13 can be avoided. Consequently, each time the soft tape 13 is deformed, the soft tape 13 recovers its original shape, and even when opening and closing operations of the baffle 4 are repeated, the soft tape 13 maintains its original shape, and a gap may not be generated between the protruded section 3*c* and the baffle 4 even after the device is used for a long time.

Also, when the second protrusion 21*b*, which functions as a stopper, is structured such that the baffle 4 is stopped at a position further shifted in the closing direction from the expected stop position at which the baffle 4 places the opening 3 in a fully closed position, the second protrusion 21*b* merely functions as a safeguard, and does not operate in normal operational conditions.

[Other Embodiments]

In the embodiments described above, a motor-operated damper device has a structure in which a buffer member such as a soft tape is attached to a baffle, and a circumferential edge section of an opening section sinks in the soft tape. However, in another embodiment, a motor-operated damper device may have a structure in which a soft tape may be attached to the circumferential edge section of the opening section and the baffle may sink in the soft tape.

As described above, in a motor-operated damper device in accordance with the embodiments of the present invention, the rotation power of the motor is transmitted to the baffle, and the baffle is moved to open and close the opening section. When the baffle closes the opening section, a force is applied to the baffle in the closing direction by a detent torque of the motor. For this reason, the opening section is securely closed by the baffle, and the baffle does not need to be pushed by a spring device such as a leaf spring. Also, since a buffer member is provided at the baffle, the circumferential edge section of the opening section sinks in the buffer member when the baffle closes the opening section, such that the baffle securely closes up the opening section. Furthermore, since the motor-operated damper device in accordance with the embodiments of the present invention is equipped with a stopper that prevents the circumferential edge section of the opening section from excessively sinking into the buffer member, the buffer member does not excessively deform. Accordingly, each time the buffer member is pressed by the circumferential edge section of the opening section, the buffer member recovers its original shape; and even when opening and closing operations of the baffle are repeated, the buffer member recovers its original shape, and a gap may not be generated between the opening section and the baffle even after the device is used for a long time.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A motor-operated damper device comprising:

a baffle driving device equipped with a motor;

a baffle that is driven by the baffle driving device;

a frame defining an opening section that is closed and opened by the baffle, the opening section having a peripheral edge section;

a buffer member that is attached to one of the baffle and the peripheral edge section of the opening section and that resiliently deforms and contacts an other of the baffle and the peripheral edge section of the opening section when the opening section is closed by the baffle, wherein the motor uses a detent torque thereof to maintain a stopping state at a first position in which the buffer member is resiliently deformed to provide a close contact with the other and in which the buffer member is capable of recovering its original shape; and a stopper that prevents the other from sinking into the buffer member past a second position beyond which the buffer member will be permanently deformed, wherein the motor has sufficient torque to cause the other to sink into the buffer member against a resilience of the buffer member to the second position.

2. A motor-operated damper device according to claim 1, wherein the buffer member is attached to the baffle and contacts the peripheral edge section of the opening section.

3. A motor-operated damper device according to claim 2, wherein the stopper prevents the peripheral edge section of the opening section from sinking into the buffer member past the second position.

4. A motor-operated damper device according to claim 3, wherein the motor has a torque that allows the peripheral edge section of the opening section to deform the buffer member against a resilience of the buffer member to the second position.

5. A motor-operated damper device according to claim 4, wherein the motor is driven until the baffle reaches the second position, the baffle is prevented by the stopper, and the baffle is maintained in a state in which the peripheral edge section of the opening section is kept in close contact with the buffer member by a detent torque of the motor.

6. A motor-operated damper device according to claim 5, wherein, when the motor is stopped at the second position, the baffle is kept in a state in which the peripheral edge section of the opening section is in close contact with the buffer member at a position where a resilient returning force of the buffer member balances with the detent torque of the motor.

7. A motor-operated damper device according to claim 3, wherein the baffle driving device includes a case that contains the motor and a reduction gear train that transmits an output of the motor to the baffle, and the stopper is provided within the case.

8. A motor-operated damper device according to claim 7, wherein the case has an inner wall surface, and the stopper is a protrusion extending inwardly from the inner wall surface.

9. A motor-operated damper device according to claim 8, wherein the reduction gear train is composed of a plurality of gears, and the protrusion interferes with one of the plurality of gears that rotates less than one full turn at a baffle stop position while the baffle moves from a complete open state of the opening section to a complete close state of the opening section to thereby stop the baffle.

10. A motor-operated damper device according to claim 9, wherein the peripheral edge section of the opening section is prevented at the baffle stop position from sinking in the buffer member past the second position.

11. A motor-operated damper device according to claim 3, wherein the stopper is provided at a position that stops a closing operation of the baffle further shifted in a closing direction from an expected stop position where the baffle places the opening section in a complete close state.

12. A motor-operated damper device according to claim 1, wherein the motor is driven until the baffle reaches the second position, and the baffle is maintained in a state in which the other is kept in close contact with the buffer member by a detent torque of the motor.

13. A motor-operated damper device according to claim 12, wherein, when the motor is stopped at the second position, the baffle is kept in a state in which the other is in close contact with the buffer member at a position where a resilient returning force of the buffer member balances with the detent torque of the motor.

14. A motor-operated damper device according to claim 1, wherein the baffle driving device includes a case that contains the motor and a reduction gear train that transmits an output of the motor to the baffle, and the stopper is provided within the case.

15. A motor-operated damper device according to claim 14, wherein the case has an inner wall surface, and the stopper is defined by a portion of the inner wall surface.

16. A motor-operated damper device according to claim 14, wherein the case has an inner wall surface, and the stopper is a protrusion extending inwardly from the inner wall surface.

17. A motor-operated damper device according to claim 14, wherein the reduction gear train is composed of a plurality of gears, and the stopper interferes with one of the plurality of gears that rotates less than one full turn at a baffle stop position while the baffle moves from a complete open state of the opening section to a complete close state of the opening section to thereby stop the baffle, and the other is prevented at the baffle stop position from sinking into the buffer past the second position.

18. A motor-operated damper device according to claim 1, wherein the stopper is provided to stop the baffle at a position that is further shifted in a closing direction from an expected stop position where the baffle places the opening section in a complete close state.

* * * * *